United States Patent [19]

Hedstrom

[11] 4,043,049

[45] Aug. 23, 1977

[54] PROCESS AND APPARATUS FOR FLASH DRYING FLUFFED CELLULOSE PULP

[76] Inventor: Bengt Olof-Arvid Hedstrom, 4, Hultgrensgatan, S-412 59 Goteborg, Sweden

[21] Appl. No.: 614,568

[22] Filed: Sept. 18, 1975

Related U.S. Application Data

[63] Continuation-in-part of Ser. No. 559,278, March 17, 1975, abandoned.

[30] Foreign Application Priority Data

Mar. 22, 1974 Sweden ..... 7403903

[51] Int. Cl.[2] ..... F26B 3/08; F26B 3/10; F26B 17/00

[52] U.S. Cl. ..... 34/10; 34/57 A

[58] Field of Search ..... 34/10, 57 A, 57 R

[56] References Cited

U.S. PATENT DOCUMENTS

| | | | |
|---|---|---|---|
| 2,014,764 | 9/1935 | Gram | 34/10 |
| 3,654,705 | 4/1972 | Smith et al. | 34/10 |
| 3,707,775 | 1/1973 | Kaltin | 34/57 R |
| 3,808,093 | 4/1974 | Hedstrom | 34/57 A |

*Primary Examiner*—John J. Camby

[57] ABSTRACT

Process and apparatus are provided for flash-drying cellulose pulp in a particulate form to be entrained in steam at an elevated pressure, employing steam both to heat the steam-entrained cellulose pulp via a heat-transfer surface, and to serve as carrier gas for the cellulose pulp that is being flash-dried.

15 Claims, 11 Drawing Figures

PROCESS AND APPARATUS FOR FLASH DRYING FLUFFED CELLULOSE PULP

This application is a continuation-in-part of Ser. No. 559,278, filed Mar. 17, 1975, and now abandoned.

The particular technique applied for the drying of cellulose pulp has an effect upon its beating and strength properties. Hartler and Teder, *Paper Technology* 4 (4): T129 (1963) by taking samples at different positions in conventional drying machines showed that beatability and tensile strength decreased and tear strength increased as a result of the drying. Aldred and White in a paper presented to the Eucepa-TAPPI meeting in Venice, 1964, stated that flash drying affects the beatability and strength of unbleached kraft pulp in the same way as conventional drying, and that wet pressing will lower burst strength considerably.

These observations were confirmed by Engstrom, Hovstad and Ivnas, *Pulp & Paper,* Aug. 21 and August 28, 1967. They concluded however that it is possible by flash-drying process to produce an unbleached dried kraft pulp that in all respects is very close to slush pulp, and the only drawback they reported was the risk of producing a pulp with fiber bundles or nodules that are difficult to put into homogeneous suspension, and which may cause fish eyes or specks in paper made from such pulp. They showed that nodule formation could be avoided, if the fiber bundles entering the dryer had a density below a certain limit, and they were able to maintain the required density by improved fluffing of the pulp.

Engstrom et al in their report included a flow sheet setting forth the conventional steps of the flash-drying of pulp, including a wet system, a drying system and a slab press. The pulp slurry enters a dewatering press, in which the pulp is drained on the roll faces and forms a pulp web, which is carried forward by the rotation of the rolls to the nip, where it is pressed to a solids content of from 45 to 50%. Beyond the nip, the pulp web is taken off by a doctor blade, and leaves the press by way of a doctor table.

The pulp web taken off the dewatering press is usually first shredded to coarse flakes in one stage. The apparatus can be described as a combination between a fluffer and a transport screw. The flakes are then fluffed in a second or fluffer stage to a much higher surface area, that is, much smaller particles.

In the fluffer, all defibration is done in one stage. The fluffer described in the article consists of two rolls, one of which is the fluffing roll, which rotates at high speed, while the other rotates with the same peripheral speed as the wet press. The fluffed pulp is conveyed pneumatically into the dryer, and the wet conveying air is separated in a cyclone.

The dryer is arranged in two countercurrent stages. In the first stage, the pulp is mixed with hot air from the second stage; in the second stage, the pulp meets the hot gases from the air heater.

In the first stage, the pulp passes through a fan into a drying duct, and from the duct into a cyclone, where the pulp is separated from the wet air, and reaches a solids content of approximately 55 to 60%. The partially dried pulp is mixed with hot air and brought by a fan into the second drying duct where final drying occurs to about 90% dryness. The pulp is then separated from the drying air and passed to a conditioning stage where it is cooled down to a temperature convenient for baling and storing. The pulp is then formed into slabs in a slab press.

Shredding and fluffing of the pulp web from the dewatering press is quite important, from the standpoint both of economy and of the quality of the pulp. In order to dry the pulp particles rapidly, it is important that they have as high a surface area as possible. Pulps that are well fluffed show the lowest heat consumption. Some pulps are easier to fluff than others. Groundwood and high alpha pulps are easy to fluff, and have a low heat consumption during drying, while unbleached kraft and unbleached sulfite pulps which are more difficult to defibrate are also more difficult to fluff.

The degree of fluffing in addition to increasing the available drying surface also affects the air velocities needed for carrying the pulp particles through various parts of the drying system. Smaller and lighter particles require a lower air velocity to keep them entrained, which means a reduced air volume, a higher ingoing temperature, and a higher thermal efficiency.

These requirements have caused difficulties in flash-drying. The fact is that the drying equipment heretofore available for flash drying has a relatively low efficiency of utilization of heat, and large quantities of hot gases are required to carry heat into the fluffed pulp material to be dried. The inefficient utilization of heat is an especially serious disadvantage in pulp mills requiring large amounts of hot water, as is usually the case of kraft pulp mills. Moreover, in many flash-drying processes there is a risk that an excessively high gas temperature will be reached during the drying, and will result in deterioration in the quality of the pulp. The gas conveying systems in many known devices are subject to wide fluctuations in flow characteristics, that result in frequent obstructions and blockages of the equipment, and require shut-down of the system for cleaning, which of course reduces production.

Hedstrom, U.S. Pat. No. 3,808,093 patented Apr. 30, 1974, Canadian Pat. No. 947,498, patented May 21, 1974, provides a method and apparatus for flash-drying pulp including heat exchange and temperature equalizing zones.

This method and apparatus overcome problems associated with heat-transfer by providing heat exchange in several separate zones along the path of the pulp gas mixture. The ratio of pulp flakes to gas and the properties of the conveying system are established and controlled to provide stable flow conditions that promote high efficiency of heat utilization and a minimum risk of blockages in the equipment. The pulp is dried under suitable temperature conditions while producing a hot effluent gas that can be utilized efficiently in heating water for use in other parts of the mill.

The pulp flakes are entrained in a gas such as air, in an amount not greater than 0.35 kg dry weight of pulp per 1.0 kg of dry gas. Preferably the air or other gas is preheated prior to introducing the pulp flakes. The gas flakes mixture is then conducted through a conduit system that is constructed to provide a multiplicity of units, each having a heat-transfer zone and a temperature-equalizing zone, arranged in series. Each unit comprises a heat-transfer zone constituted by a length of conduit containing a heat exchanger, preferably in the form of a multiplicity of spaced-apart tubes extending parallel to the axis of the conduit and of appropriate length and surface area to provide a desired heat input in each zone.

The supply of heat in the heat-transfer zone and the moisture contents of the flakes and gas processed through the equipment are controlled so that the gas discharged from the device has a wet-bulb temperature of not less than about 60° C and a dry-bulb temperature of not greater than about 120° C. The heated portion of the flow path along which the gas-flakes mixture flows has a hydraulic diameter not greater than about 200 mm.

Preferably, the tubes are heated by conducting steam at a low saturation pressure in the range of from about 0.2 MPa to about 1.2 MPa. As the mixture of gas and flakes flows past the heat-exchanger section of each unit, heat is transferred into the gas and flakes. Each unit of the apparatus further includes a temperature-equalizing zone downstream from the heat-transfer zone. As the pulp flows through the temperature-equalizing zone of each unit, the temperatures of the flakes and the gas become substantially equalized, thus ensuring high efficiency and preventing the attainment of overly high gas temperatures. Consequently, the production of a high quality pulp is ensured.

Since in the system of these patents the heat-transfer surface extends the length of the drying unit, it is not necessary to separate wet air and pulp between the various drying steps. The mixture of air and pulp is heated in each drying step indirectly by means of the heat transfer surfaces, which are themselves heated with steam. Thus, it is possible to maintain a relatively high average temperature difference between the heating surface and the carrier gas used to transport the wet pulp through the dryer.

Previously, more or less generally useful methods of improving the heat economy in conventional drying systems have also been suggested, which operate at essentially atmospheric pressure and with air as drying medium. In a well-known system for peat drying (Bauart VEB, Kneule, "Das Trocknen", Aarau, Switzerland, 1959, page 290) heat in the wet air from steam heated drying steps is thus utilized for producing hot water. This is used as heat source in the other drying steps, all being arranged substantially conventionally, operating at atmospheric pressure and with air as drying medium. The heat economy is reported to be improved to about 1.75 MJ/kg of evaporated water.

It has been suggested that drying systems can be provided with heat pumps (Kneule, page 291, cited above) which also operate under conventional conditions, at substantially atmospheric pressure and with air as drying medium, the more or less wet drying air is compressed and expands, respectively, giving off heat in a work cycle, which is in principle similar to the conventional one used in steam processes, e.g. evaporation with a heat pump.

In accordance with the present invention, it has been determined that a considerably-improved heat-transfer and a considerably improved heat economy is obtained in the flash drying of particulate cellulose pulp if, as the carrier gas, there is employed steam at a pressure of at least from about 0.12 to about 0.15 MPa, which steam is derived at least in part by evaporation from the entrained pulp.

The cellulose pulp is in a sufficiently particulate form that it can be entrained in steam, such as in flake or in fluffed form. The necessity for a high surface area in the particles is more pronounced in conventional air drying systems than in the steam drying system of the invention, because drying is much more rapid in steam than in air. Consequently, coarse particles such as flakes can be fed to the dryer as well as fluffed pulp (defibrated pulp).

The particulate cellulose pulp while entrained in such steam is conducted through a pressurized conduit system that is constructed to provide a multiplicity of pressure units, each having a heat-transfer zone and, optionally, a temperature-equalizing zone, arranged in series. The heat-transfer zone is constituted by a length of conduit containing a heat exchanger, preferably in the form of a multiplicity of spaced apart tubes whose walls constitute the heat-transfer surfaces, extending parallel to the axis of the conduit, and of appropriate length and surface area to provide a desired heat input in each zone. The mixture of steam-entrained particulate cellulose pulp can pass either outside of or within the tubes, and on the other side of the tubes heating steam is supplied. Heating steam gives off heat mainly by condensation.

The tubes are heated by steam, referred to herein as "heating steam", whose saturation pressure exceeds the pressure of the steam used to entrain the particulate cellulose pulp, referred to herein as "carrier steam". Preferably, the tubes are heated by steam at a pressure within the range from about 0.3 MPa to about 2 MPa. As the mixture of entrained particulate cellulose pulp and steam flows past the heat exchanger section of each unit, heat is transferred into the steam and particulate cellulose pulp.

Each unit of the apparatus may further include a temperature equalizing zone, downstream from the heat-transfer zone. As the particulate cellulose pulp flows through the temperature equalizing zone of each unit, the temperature of the particles and the steam become substantially equalized, thus ensuring high efficiency, and preventing the attainment of over-high gas temperatures. Consequently, the production of a high quality dried pulp is ensured.

The steam used as carrier steam is recycled, at least in part, for reuse as carrier steam for cellulose pulp particles to be dried, and carried through the dryer system. Such steam may be reheated or super-heated prior to use as the carrier steam. As an essential feature of the invention, the remainder of the carrier steam, the surplus produced by drying of the pulp, is used as primary-process-steam, for the drying of paper, evaporation, bleaching, or the like, in another part of the pulp mill. This use of the surplus steam, produced in the pulp dryer of this invention, considerably improves the heat economy of the pulp drying process, and consequently also the heat economy of the whole mill.

The cellulose pulp particles are brought to the desired pressure in the drying conduits using, for example, a rotary seal valve or other pressure-sealing transfer valve of conventional design. Blowers, designed as pressure-vessels, are arranged in the drying conduit system for driving the steam and entrained pulp particles through the system.

Similar pressure-sealing valves can be used at the end of the conduit system, for delivery of the dry pulp particles.

Prior to discharge of the dry pulp particles from the drying unit, the steam used as the carrier gas should be separated. This can be done in any kind of separator, such as, for example, a cyclone. The separated steam can be recycled and reheated for reuse as carrier steam, or used in another part of the pulp mill for heating purposes, or both.

The conduit system employed in carrying out the process of the invention can be that described in U.S. Pat. No. 3,808,093 and Canadian Pat. No. 947,498, referred to above. However, the drying units must be capable of operation under a moderate internal pressure, within the range from about 0.4 to about 0.7 MPa.

Stable flow conditions in the equipment are maintained by controlling a combination of factors. The ratio of particulate cellulose pulp to gas is held below 0.35 kg of pulp, dry weight, per 1.0 kg of gas. It has been found that a pulp loading significantly above that limit increases the likelihood of formation of a fiber network which easily can cause clogging. In addition, the cross-section of the conduit system is dimensioned and shaped so that the velocity profile at any zone in the system does not have any unstable parts of the same order of size as the flocs or aggregations of pulp that tend to form in the system due to the inherent property of fluffed pulp. It has been found that the flocs or aggregates generally have a size of the order of 50 mm to 100 mm, a range which corresponds roughly to the unstable part of a velocity profile in a conduit having a hydraulic diameter of about 200 mm. Accordingly, it is preferred but not essential that the construction of the flow system be such that the hydraulic diameter at any heated zone in the system does not exceed about 200 mm.

In one preferred embodiment of the apparatus, the conduit system is formed by a multiplicity of laterally adjacent, generally parallel conduit sections. Alternate ones of the conduit sections contain the heat-exchangers and the remaining sections constitute at least portions of the temperature-equalizing zones. Adjacent pairs of heat-transfer sections and temperature-equalizing sections are connected together by elbows to place the temperature-equalizing section downstream of the corresponding heat-transfer section in each unit. The cross-sectional area of each elbow decreases in proportion to the distance of any given cross-section from the upstream end to ensure against the establishment of a stagnation zone at the downstream, radially inward end of the elbow and thus prevent turbulence and back flow and a possibility of an unstable flow condition and possible blockage of the conduit. Preferably, to compensate for the pressure drop, caused by the gas flow in the drying conduits, the steam and particulate cellulose pulp mixture is periodically conducted through conveyor fans. Such fans may be located near the downstream end of each temperature-equalizing zone of the system. The conveyor fan may provide the connection between each adjacent pair of units in the system. Advantageously, the conduit sections are oriented vertically with the elbows uppermost and the conveyor fans lowermost. In that case, the fans are conveniently and readily mounted on footings, which is of considerable advantage from the point of view of an efficient structural arrangement.

The initial cost of the equipment is relatively low, because heating takes place at several stages with temperature equalization between the heat-transfer stages. Consequently, the quantities of gas to be handled will be small, and the conveyor fans and other components of the equipment may be commensurately small and thus of lower cost.

A unit having conveyor sections arranged vertically in parallel, side-by-side relation occupies a minimum of space and is structurally durable. The equipment can be located outside with appropriate coverings required only for the motors and instrumentation. This means further savings in cost.

In such drying apparatus, as in the apparatus of U.S. Pat. No. 3,808,093, and Canadian Pat. No. 947,498, the drying units are heated indirectly by means of heating steam allowed to condense in a number of tubes arranged in the drying units. Heat is transferred through the tube wall from the heating steam in the tubes to the steam-entrained particulate cellulose pulp mixture on the other side of the tube. Consequently, the steam temperature within the tubes is reduced, and the steam therein is normally condensed. This heating steam can have a saturation pressure of from 0.2 to 0.3 MPa, up to 1.2 MPa, and more, or in any case higher than the saturation pressure of the carrier steam used in the present invention.

It is also possible, in addition to the arrangement shown in these patents, to pass the particulate cellulose pulp and steam through tubes from a lower end portion to an upper end portion, the tubes being surrounded by steam for indirect heating of the pulp and carrier steam in the tubes. The tubes can, for example, be arranged in triangular configuration.

With such a system, excellent heat economy is obtained in accordance with the invention, as indicated, for instance, in a larger coefficient of heat transfer. This coefficient in an apparatus according to U.S. Pat. No. 3,808,093, Canadian Pat. No. 947,498, using air as a carrier gas, can be calculated to be 63 $W/m^2K$. However, if steam at atmospheric pressure is used as the carrier gas, the coefficient is calculated to be 70 $W/m^2K$. In the present process, the coefficient is calculated to be 190 $W/m^2K$, at a pressure of 0.4 MPa. These calculations have assumed a gas velocity of 27 meters per second, at a hydraulic diameter of 0.176 meter in the system. From these figures it is obvious that increasing the saturation pressure gives rise to larger coefficient of heat transfer.

In order to obtain this considerable improvement in convective heat-transfer, the steam used for indirect heating of the drying units must have a saturation pressure exceeding the pressure of the steam employed as a carrier gas for conveying the particulate cellulose pulp through the system. The pressure in the drying unit is at least 0.12 to 0.15 MPa, and preferably at least 0.2 to 0.4 MPa.

The steam used for indirect heating has, as indicated, a minimum saturation pressure of 0.2 to 0.3 MPa, and the saturation pressure can be raised still more, to 1.2 MPa and higher. As the pressure of the carrier steam in the process of the invention is maintained considerably above atmospheric pressure, i.e., at at least 0.12 to 0.15 MPa, and preferably at least 0.2 to 0.4 MPa, a considerable increase in the surface coefficient of heat-transfer is obtained, which in turn leads to surprisingly large savings, in view of investment and operation costs. The necessary heat-transfer surfaces can be made smaller, as a result of the improved convective heat-transfer.

Calculation shows that the required heat-transfer surface area in a drying system according to the invention is about half that required for the drying system of U.S. Pat. No. 3,808,093 and Canadian Pat. No. 947,498. Thus, the drying system of the invention, although to the same design as of these patents, can be half its size. Thus, the capital costs are less, even if the drying units are designed as pressure vessels, and the auxiliary equipment also is designed for operation under pressure.

It is believed that this is the first drying system provided for drying particulate cellulose pulp that operates at an elevated pressure.

The drawings illustrate preferred embodiments of the invention.

Figure 3:
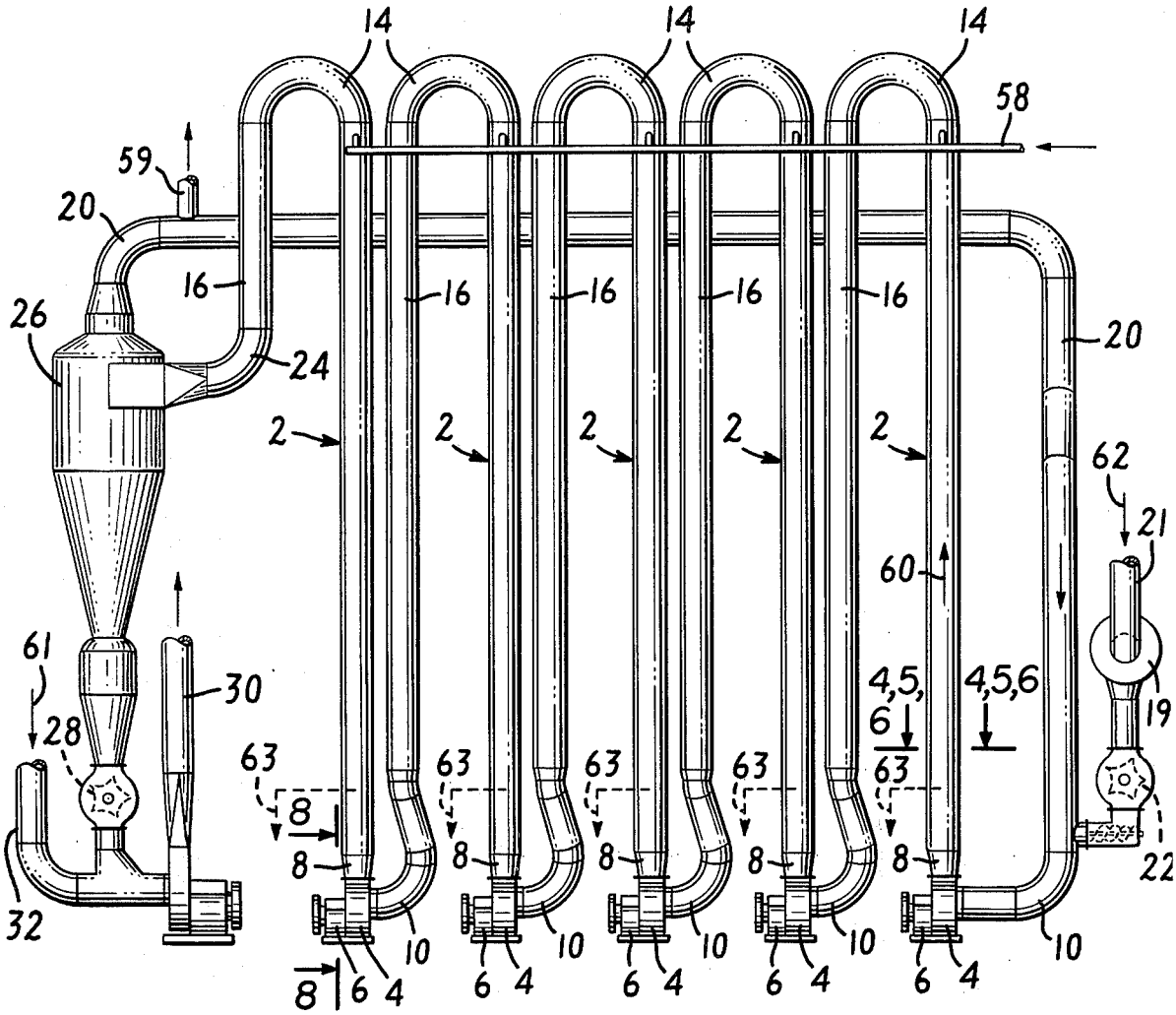
FIG. 3 is a side elevational view of a third embodiment of drying apparatus in accordance with the invention, in generally schematic form.
Figure 7A:
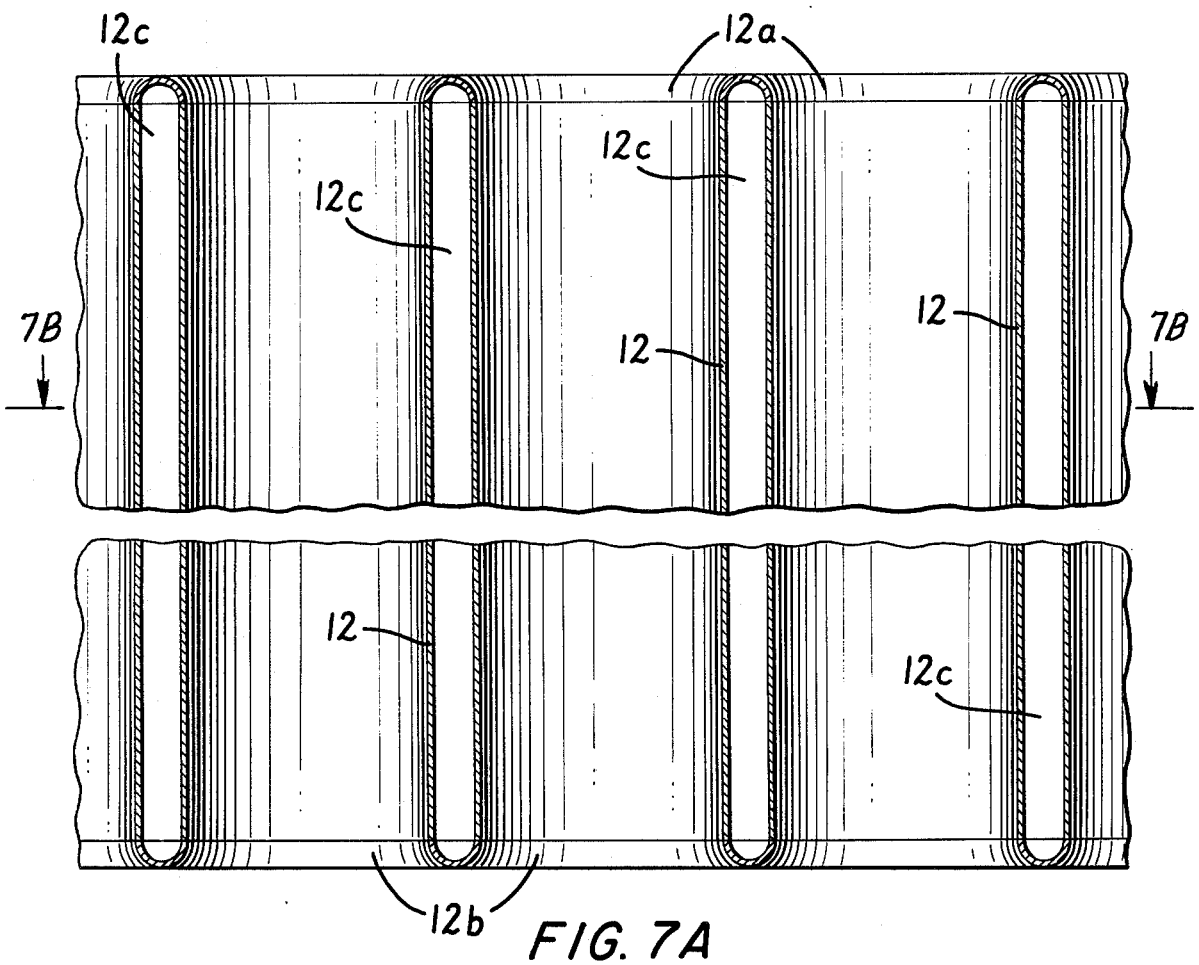

FIG. 7*a* is a side elevation on an enlarged scale showing the end arrangement of the heat-transfer tubes within the tower of FIG. 3.

Figure 7B:
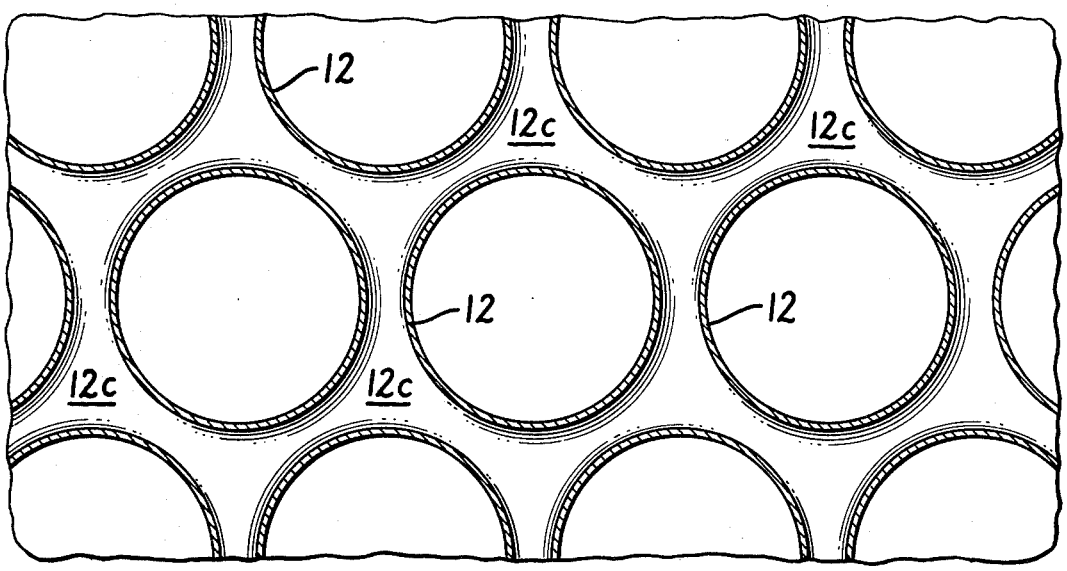

FIG. 7*b* is a cross-section taken along the line 7*b*—7*b* of FIG. 7*a*.

Figure 8:
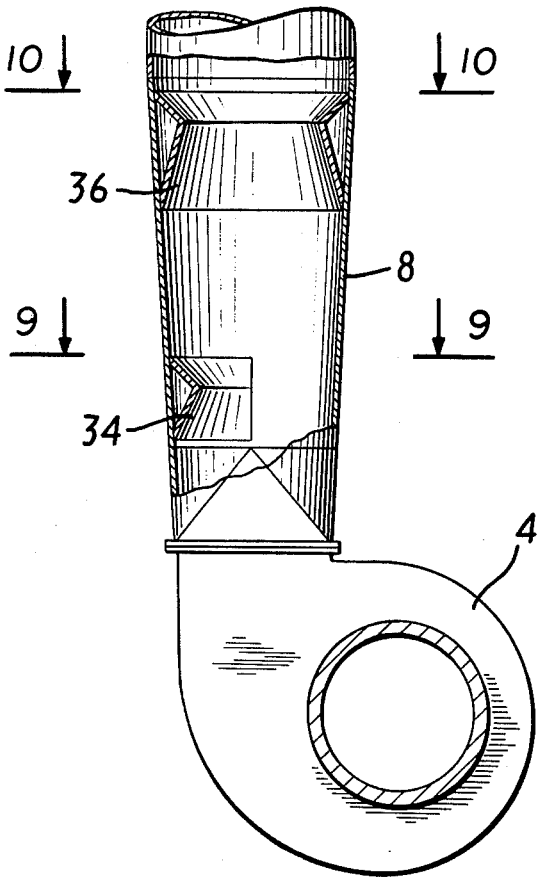

FIG. 8 is a detailed longitudinal section on an enlarged scale of the tower portion indicated by the line 8—8 of FIG. 3.

Figure 9:
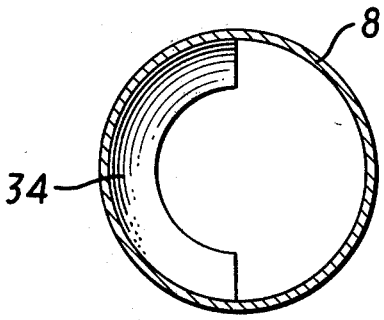

FIG. 9 is a cross-section taken along the line 9—9 of FIG. 8, and

Figure 10:
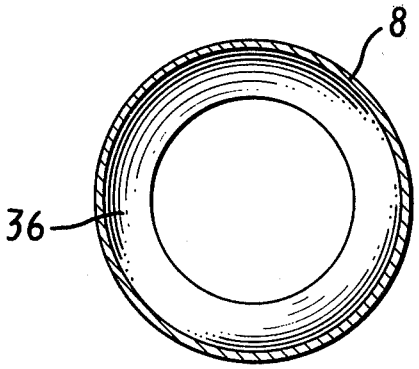

FIG. 10 is a cross-section taken along the line 10—10 of FIG. 8.

Figure 1:
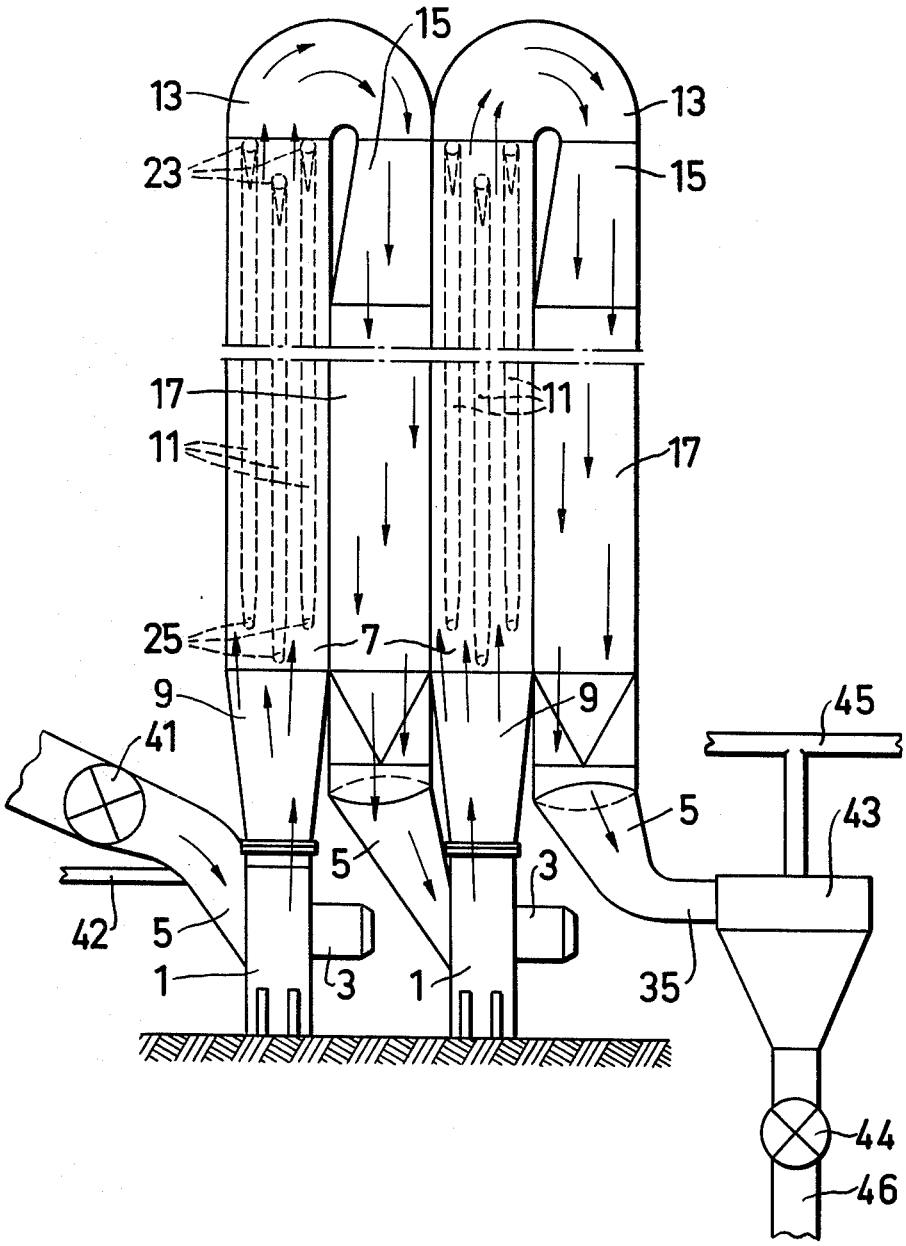
FIG. 1 is a side elevational view of two units of one embodiment of drying system in accordance with the invention, the view being generally schematic and in diagramatic form, with a central portion of the equipment broken out to reduce the height of the Figure

In FIG. 1 only two of six or more drying units connected in series and in the form of drying towers are shown. These towers are provided with transport fans 1 with directly connected driving motors 3. On the suction side of the fans conical supply pipes 5 are connected. On top of the outlet pipes of the transport fans 1 the drying towers 7 are mounted and connected with conical connections 9. The drying towers, which may have any cross-section, e.g. circular or square, are internally provided with tubes 11 arranged for indirect heating circulation of heating steam therethrough, and serving as long heat-transfer surfaces for the steam-entrained coarse flakes or fluffed pulp passed along their outside surface.

At their upper ends, the drying towers are connected to an elbow 13, and connected to conveyor ducts 17 via tapered connection ducts 15. The conveyor ducts 17 are in turn connected to the conical supply pipe 5, and a steam supplied pipe 42, for entry of steam, which is optionally superheated at a pressure of about 0.15 to about 0.5 MPa. This steam supply pipe if desired can be connected elsewhere to the conveyor ducts. The drying towers also include distributors for steam, steam headers 23 and condensate collecting pipes, condensate headers 25, and on the discharge side, an elbow 35, a cyclone 43 with discharge valve 44 for the pulp, and discharge pipes 46 for pulps as well as steam conduit 45.

According to the invention the pulp is supplied in the form of coarse flakes or fluffed pulp through the pressure-sealing rotary valve 41 to the suction side of the transport fan 1, while steam, superheated if desired, e.g. at a temperature range from about 120° C to about 190° C, for example, at about 144° C, is supplied through the conduit 42. The transport fan 1 then conveys the mixture of steam and coarse pulp flakes or fluffed pulp through the conical connection 9 and the conveyor duct or drying tower 7. On the heating side of the steam tubes 11 mounted inside the conveyor duct 7 steam is supplied at a pressure of about 0.3 MPa to about 2 MPa, for example, about 1 MPa. The tube walls are thus heated, and, due to the temperature difference between the steam-pulp mixture and the surface of the steam tubes 11, transfer of heat from the steam tubes to the mixture of steam and pulp takes place. The heat given off from the steam tubes 11 is transferred to the mixture of steam and pulp, primarily to the steam thereof, which rapidly absorbs the heat. From the steam a continued transfer of heat to the pulp takes place. As the pulp cannot absorb heat as rapidly as the steam, a temperature difference between the steam and the pulp arises during the passage through the conveyor duct 7. After passing the conveyor duct 7, the mixture of steam and pulp is diverted in an elbow 13, and passes through the temperature equalizing part of the drying unit, which comprises the elbow 13, the conical (tapered) connections 15 and 5, the conveyor duct 17 and a transport fan 1 and in the last drying unit also the cyclone. In this temperature equalizing part, the temperature difference between the pulp and the steam is reduced. This treatment of the mixture is then repeated in the series, usually three to six drying units, after which the mixture of steam and pulp leaves the apparatus through an outlet pipe 35, and is conducted to a cyclone 43, for separation of the dried pulp from the steam. The pulp is then drawn off through a pressure-sealing rotary valve 44, and the steam is led at a pressure of from about 0.15 MPa to about 0.5 MPa, for example, 0.4 MPa, to a steam line 45. From the steam line 45 some steam is led, optionally through a heat-exchanger for superheating the steam, to the steam supply pipe 42 in the first drying unit.

The quantity of carrier steam is continuously being increased, by the steam obtained from evaporation of the wet flake or fluffed pulp, as it flows through the drying conduits. This surplus of steam obtained from the drying can thus be used substantially completely for other purposes, e.g. paper drying, black-liquor evaporation, or bleaching. The remainder of the carrier steam separated in the cyclone is preferably circulated for reuse as carrier steam.

Figure 2:
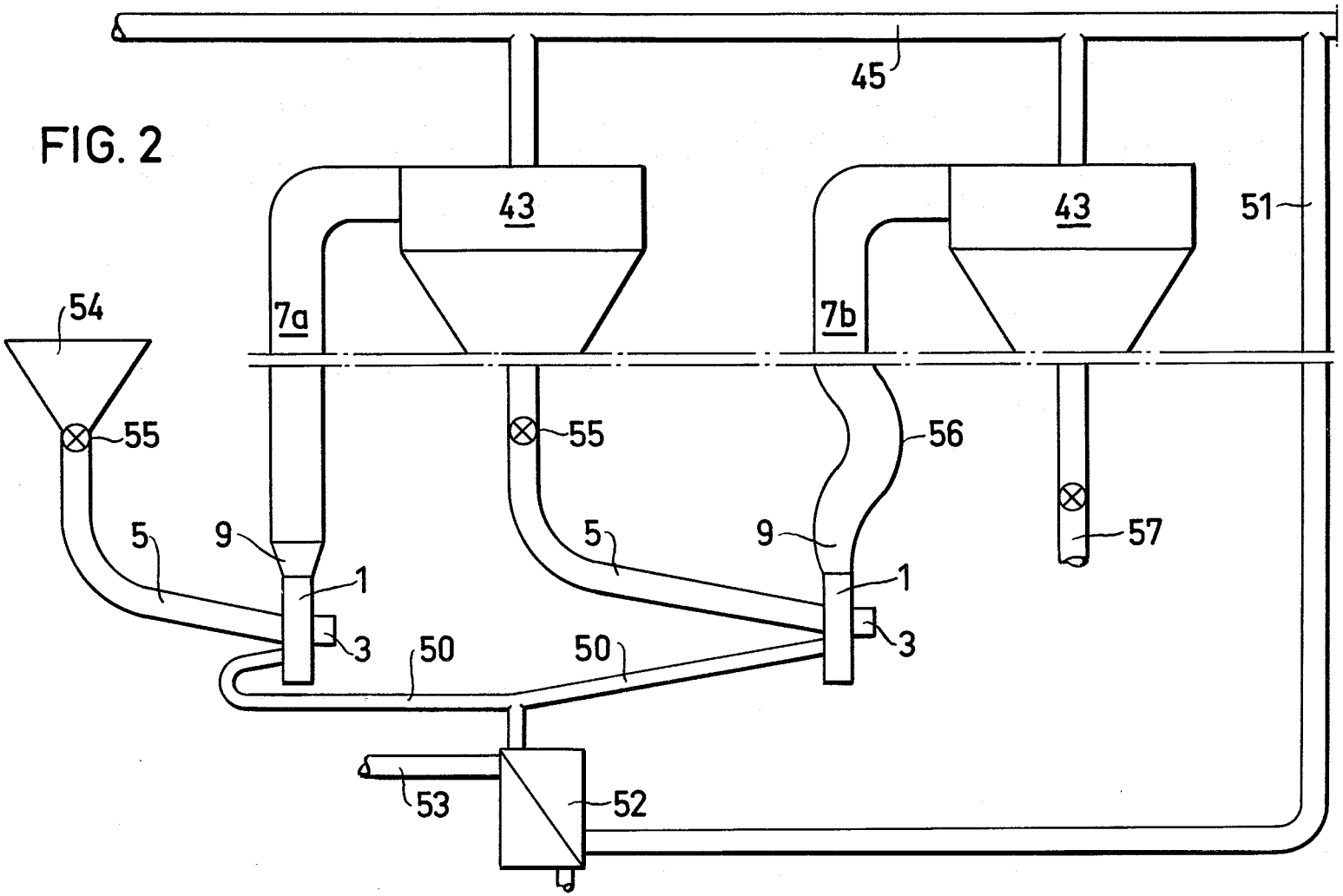
FIG. 2 shows schematically another embodiment of drying apparatus in accordance with the invention.

In FIG. 2 another embodiment of an apparatus according to the present invention is shown. It can be used in analogy with the apparatus according to FIG. 1 for carrying out the present process.

The apparatus shown in FIG. 2 comprises two drying units connected in series in the form of drying towers. Transport fans 1 with directly connected driving motors 3 are attached at the bottom of the drying towers. The suction sides of the fans 1 are connected to supply pipes 5. On top of the outlet pipes of the transport fans the drying towers 7 are arranged; they are connected with conical connections 9. The drying towers can be of any cross-section. The drying tower 7*a* is here shown as a straight non-packed pipe. On the other hand the drying tower 7*b* is shown as provided with bends. It is preferred that the drying towers be arranged in several waves or bends, as the relative speed between pulp is to be dried and carrier gas is increased in this way, which increases the rate of heat transfer. Drying towers of these types are known per se.

Each drying unit 7 is moreover connected to a cyclone 43 for separation of pulp and carrier gas. The carrier gas in the form of superheated steam is supplied to the fans 1 through pipe conduits 50. The carrier gas separated in the cyclone 43 in the form of substantially saturated steam is collected in a steam line 45. This steam line can be one common to the entire mill. From this steam line steam is drawn through a conduit 51 to a heat exchanger 52, in which the steam is superheated and supplied as carrier gas to the drying units through the conduits 50. The amount of steam drawn off steam line 45 for use as the carrier gas will be less than the amount of steam collected from the cyclones 43 to the steam line 45.

The superheating of the steam in the heat exchanger 52 is preferably carried out by means of steam at a higher pressure, e.g. 1 MPa, which is supplied through a line 53. Of course, it is possible all according to the circumstances to arrange a special heat exchanger for each drying unit, and to circulate the steam in the drying unit, and only to draw off so much steam to the steam line 45 that the amount of steam in the drying unit will be substantially constant.

In operation, the wet pulp (usually with a solids content of 40 – 50%) is supplied in the form of coarse flakes or fluffed pulp at 54 and is fed through a pressure-sealing rotary valve 55 towards the higher pressure in the drying unit. The fluffed pulp descends, and is thereafter sucked through the pipe 5 to the fan 1, to which superheated steam is simultaneously supplied through the conduit 50. From the fan 1 the pulp and the steam are blown up through the drying tower *7a,* in which heat exchange takes place between the steam and the pulp, the pulp being dried, and giving off steam. From the drying tower 7 the pulp is brought to a cyclone 43, in which dried pulp and steam are separated. The heat exchange and the drying can continue during this separation.

The separated steam is lead to the steam line 45. The pulp from the cyclone 43 is then fed through a pressure-sealing rotary valve 55 to a second drying unit, which is optionally operating at a different pressure than the first unit. The procedure in the first drying unit is thereafter repeated, the drying tower *7b* however being provided with several bends 56, which increase the drying rate. The separated pulp is discharged at 57. It is now dry (90% solids) and ready for sale.

In FIG. 2 only two drying units are shown, for the sake of simplicity, but of course it is possible to build the present apparatus in a great number of stages (drying units) and usually three to six drying stages are suitable.

As a very pure steam at a raised pressure is obtained at the present drying process, e.g. as described with an example at a pressure of approximately 0.4 MPa, it is evident that the drying of pulp in principle takes place with very small losses of energy, provided there is a suitable outlet for utilizing the steam as primary-process-steam, which is normally the case in production of cellulose pulp. In general, it can be considered that the steam used in the drying apparatus for heating purposes is throttled from the process steam pressure, e.g. about 1 MPa, to the steam pressure of the flash drying process, i.e., from 0.15 to 0.5 MPa, for example, 0.4 MPa. Thus, the present drying process can be counterpressure process by analogy with counterpressure evaporation. While these two conceptions and processes are well-known and used early in the cellulose industry, e.g. in combined sulphite spent liquor evaporation and alcohol stripping, counterpressure drying according to the invention is quite a new idea.

The following Examples are illustrative of the results obtained using the apparatus shown in FIGS. 1 and 2 for drying of fluffed pulp.

EXAMPLE 1

The fluffed pulp, solids content 45%, obtained from a sulphate digestion process, and fluffed as described by Engstrom et al, loc cit, was entrained in steam and fed to the dryer via the valve 41 and dried in indicated manner at a pressure of 0.4 MPa and 148° C to a solids content of about 87%. The dry fluff was separated from the steam in the cyclone 43, and discharged through the valve 44 and the conduit 46. Then, the pulp was expansion dried (by lowering the pressure) to about 90% solids. The steam obtained in the conduit 45 was used for evaporation of the liquor obtained in the pulping process.

EXAMPLE 2

The apparatus shown in FIG. 2 was used for partial drying of sulfite pulp. The pulp was entrained in steam and supplied as in the previous Example, dried at 0.4 MPa and 148° C to 60% solids, separated from the steam and discharged as described therein, and the steam was utilized in the same way. The pulp was conveyed after discharge to a conventional, oil-heated flash dryer or to a flash dryer according to U.S. Pat. No. 3,808,093, Canadian Pat. No. 947,498 and drying completed to 90% solids.

In the heat exchanger surface design of U.S. Pat. No. 3,808,093, Canadian Pat. No. 947,498, 51 mm tubes and 85 mm pitch are used. This design gives rise to some problems when steam is used as the carrier gas, as compared with air. The pulp dries approximately twice as fast when using steam. This means that the residence time, and therefore the number of drying towers, is halved. However, the higher heat exchange coefficient in steam drying reduces the necessary heat exchanger surface by approximately 50% of what is needed in air drying. This means that while the heat exchange surface per tower (the number of tubes in each tower) is approximately the same as in the air drying case, the volume flow of steam is only half of the volume flow of air, since the ratio of steam to air densities in the two cases is approximately 2.

This means that the free flow cross-sectional area for steam drying must be reduced to about half of that in air drying.

If the steam-entrained pulp suspension flows outside the heat-transfer tubes, this condition cannot be fulfilled without decreasing the tube pitch and increasing the tube diameter. This however cannot be done without increasing the risk of clogging, and one criterion above all is that during operation the equipment must not clog. This problem can be avoided by arranging for the steam-entrained pulp mixture to flow inside the tubes. Examples of such arrangements are shown in FIGS. 4, 6, *7a* and *7b.*

In addition, one can use comparatively large tubes (100 – 150 mm) and arrange for steam pulp flow inside the tubes.

The general layout of a complete pulp drying plant with five stages (towers) is shown in FIG. 3. This hydraulic diameter is well below about 200 mm. For given flow conditions, a small hydraulic diameter will generally give rise to higher fluid flow shear stresses, with consequent favorable floc fracture, i.e. minimize clogging problems.

Figure 4:
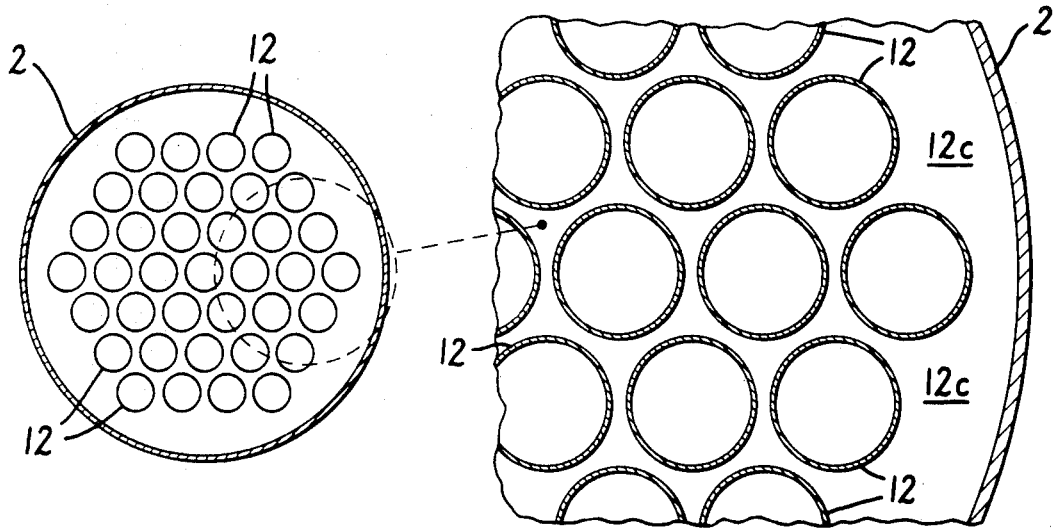
FIG. 4 is a sectional view taken along the line 4—4 of one of the drying towers shown in FIG. 3.
Figure 5:
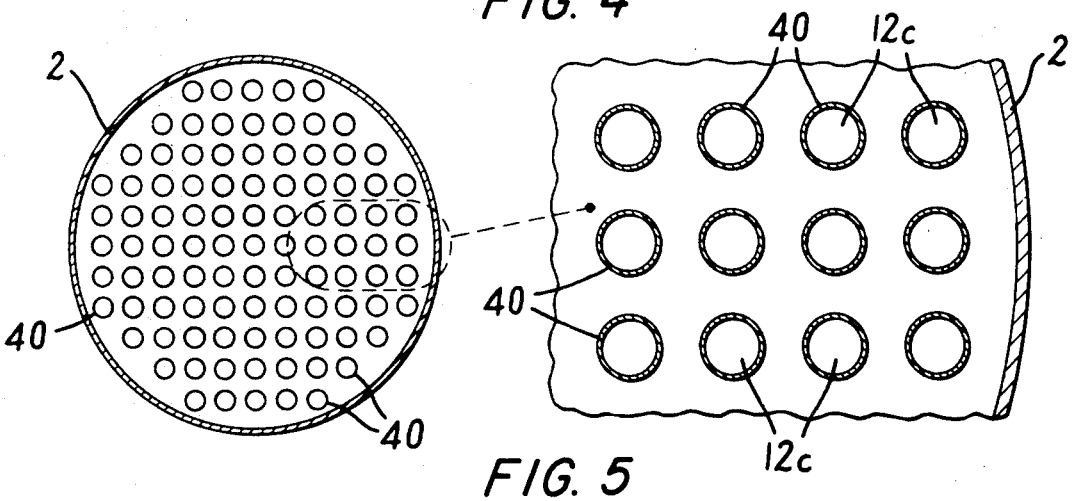
FIG. 5 is a cross-sectional view taken through another design of heat-transfer-tube-in-tower arrangement of the type shown in FIG. 3, such as the type shown in FIG. 1.
Figure 6:
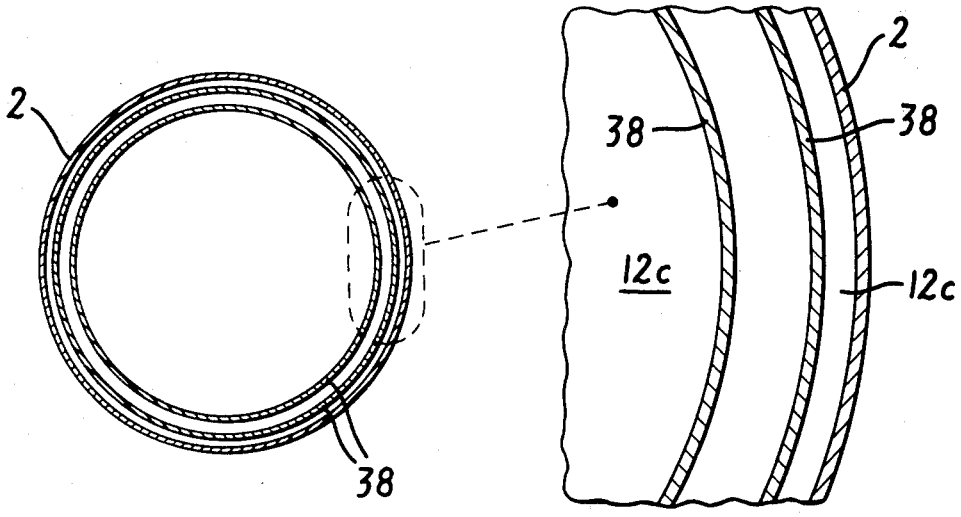
FIG. 6 is a cross-sectional view taken through another type of heat-transfer-tube-in-tower arrangement of the type shown in FIG. 3.

Various tube designs are shown in FIGS. 4, 5 and 6. Of these, the large diameter concentric tube 38 of FIG. 6 is less desirable for economic reasons, while the small diameter tube design of FIG. 5 cannot fulfill the demand for necessary heat surface without increasing the risk of clogging. The pressure of the carrier steam favors the design of FIG. 4.

In the apparatus according to FIG. 3, five drying units are connected in series and in the form of drying towers 2. These towers are provided with transport fans 4 with directly connected driving motors 6. On the suction side of the fans supply pipes 10 are connected. The drying towers 2 are mounted on top of the outlet pipes of the transport fans 4, via conical connections 8. The drying towers, which may have any cross section, e.g. a circular or square one, are internally provided with a plurality of tubes 12 through which is passed the steam-entrained fluffed pulp for indirect heating (see FIG. 4). The upper end and lower ends of tubes 12 are held in tube sheets 12*a,* 12*b* and steam is supplied about the outside of the tubes in space 12*c,* as shown in FIGS. 7*a* and 7*b.* It is important to distribute the flow of steam-entrained pulp mixture among the several heat-transfer tubes 12. This is done by baffles 34, 36, as indicated in FIG. 8, showing in detail how the fans are connected to the tubes via the conical connections. In their upper end the drying towers are connected to an elbow 14, and connected to conveyor ducts 16. The conveyor ducts 16 are in turn connected to the conical supply pipes 10, except in the first drying tower.

In the first drying tower, the supply pipe 20 for recycled carrier steam, superheated if desired, is connected with the conical supply pipe 10 via pressure-sealing rotary valve 22, in order to entrain the entering coarse flake or fluffed pulp. On the discharge side of the system are an elbow 24, a cyclone 26 with pressure-sealing pulp-discharge rotary valve 28 and pulp-discharge pipe 30. Air is supplied through pipe 32 and carries the discharged pulp via a conveyor fan through pipe 30 to the slab-press and baling equipment. Conventionally, cold air is used to cool the dried pulp before baling and storage, in pulp flash drying systems.

According to the invention, the pulp is supplied in the form of coarse flake or fluffed pulp through the rotary seal valve 22 to the suction side of the transport fan 4, simultaneously as superheated steam, e.g. with a temperature of about 144° C, is supplied through the conduit 20. The transport fan 4 will then convey the mixture of steam and flake or fluffed pulp through the connection 8 and the drying tower 2. The walls of tubes 12 mounted inside the drying towers 2 are heated by means of steam in space 12*c* at a pressure of about 1 MPa. Due to the temperature difference between the steam-entrained pulp mixture and the inner surface of the tubes 12, transfer of heat from the steam tubes to the mixture of steam and pulp takes place. The heat given off from the walls of tubes 12 is transferred to the mixture of steam and pulp and primarily to the steam thereof, which will rapidly absorb the heat. From said steam a continued transfer of heat to the pulp takes place. As the pulp cannot absorb heat as rapidly as the steam, a temperature difference between the steam and the pulp arises in the passage through the conveyor duct 2. After passing the conveyor duct 2 the mixture of steam and pulp is diverted in the elbows 14, and passes through the temperature equalizing part of the drying unit, which comprises the elbow 14, the conveyor ducts 16, and the transport fan 4, and in the last drying unit, also the cyclone. In this temperature equalizing part, the temperature difference between the pulp and the steam is reduced.

This treatment of the mixture is repeated in the series of five drying units, after which the mixture of steam and pulp leaves the apparatus through the outlet pipe 24 and is conducted to the cyclone 26 for separation of the dried fluffed pulp from the steam. The pulp is then drawn off through the rotary seal valve 28, and the steam is led at a pressure of about 0.4 MPa to the recycle steam line 20.

The quantity of steam required as carrier gas and circulating through the drying unit from the supply pipe 20 through the drying towers and back to the supply pipe 20 is substantially constant. The quantity of steam obtained from the drying of the moist pulp can thus be used substantially completely for other purposes, e.g. for drying, black liquor evaporation or bleaching.

The following Examples illustrate design and operation parameters for a typical steam pulp dryer according to FIGS. 3 to 10.

EXAMPLE 3

The apparatus of FIGS. 3, 4 and 7 to 10 was used with vertical tubes for transport of the pulp and the carrier steam in the drying units. The tubes were made of stainless steel and surrounded by heating steam, and attached together in manifolds at their upper and lower end portions. From the upper tube end portions the pulp and the carrier gas are led through an elbow to the next fan. The tubes had an outer diameter of 129 mm, and an internal diameter of 125 mm. Twenty such tubes each 20 m long were arranged with a triangular configuration of 150 mm in a mantle 750 mm in diameter. With six such drying units (towers) arranged in a series, a production rate of 300 tons per day of fluffed pulp at a heating steam pressure of 1.0 MPa at a rate in the tubes of 30 m/s was obtained.

EXAMPLE 4

For a standard capacity of 330 tons air dry bleached sulfate pulp per day,

Wet, 48% solids content

Brightness 90.5% (SCAN C1162)

Viscosity, 881/cm³/g (SCAN C1562) dried to 90% solids content, five or six towers are needed, height 18 m, 38 tubes, 100 mm diameter, in each tower.

Heating steam pressure: 1.1 MPa

Pressure of carrier steam (through the 100 mm tubes):0.4 MPa.

Steam/pulp velocity inside tubes: 30 m per second.

These conditions give rise to the following energy economy:

Gross 650 – 700 kcal (2700 – 2900 kJ) per kg evaporated water, net 150 – 200 kcal (600 – 800 kJ) per kg evaporated water.

Pulp load: 0.2 kg dry pulp per kg 0.4 MPa steam.

Steam produced: 0.9 ton 0.4 MPa steam per ton air dry pulp.

Electric energy consumption per kg evaporated water: gross 200 – 225 kJ. The input of electric energy corresponds to about 10% of the gross heat energy consumption.

Of course the drying of the pulp can be carried out in steps in another way as stated; thus it is possible in principle to carry out the present process in two or more steps arranged in analogy with a conventional multiple effect evaporation. However, that embodiment seems at present to be of less interest.

In extensive investigations of the pulp dried according to present invention (neutralized fir and birch sulphate pulps bleached to maximum brightness) it has been found that the pulp has not been negatively influenced from any qualitative point of view by such a long treatment with steam as 4 minutes at a steam pressure of 0.4 MPa. It has also surprisingly been found that the number of nodules or fiber bundles in the pulp seems to be reduced to a large extent or disappear. This may possibly be ascribed to the presence of low-viscous water at a high temperature for some part of the time, during which the pulp is present in the drying system.

It should also be mentioned that also the residence time of the pulp is reduced in comparison with known processes, which operate under atmospheric pressure. This is generally speaking an advantage from a qualitative point of view.

Having regard to the foregoing disclosure, the following is claimed as the inventive and patentable embodiments thereof:

1. In the process for the flash drying of particulate cellulose pulp, comprising the steps (1) entraining the pulp particles in a gas, (2) establishing and maintaining a flow of the gas-particulate cellulose pulp mixture along a confined path, (3) transferring heat into the gas-particulate cellulose pulp mixture in a heat-transfer zone along the path, and (4) repeating step (3) in a successive series of heat-transfer zones, the improvement which comprises employing as the carrier gas steam under a pressure of at least 0.12 to 0.15 MPa; supplying heat to the heat-transfer zone as heating steam whose saturation pressure exceeds the pressure of the carrier steam; and then separating the fluffed cellulose pulp and carrier steam.

2. The process as claimed in claim 1, wherein the pressure of the carrier steam is at least 0.2 to 0.4 MPa.

3. The process as claimed in claim 1, wherein the fluffed cellulose pulp and the steam are in a ratio not greater than about 0.35 kg dry weight of pulp to 1.0 kg of steam.

4. The process as claimed in claim 1, wherein after separation part of the carrier steam is recycled, for reuse as carrier steam.

5. The process as claimed in claim 1, wherein after separation part of the carrier steam is used for drying of paper at a pressure of from 0.2 to 0.5 MPa.

6. The process as claimed in claim 1, wherein the carrier steam is superheated to a temperature within the range from about 120° C to about 190° C prior to mixing with particulate cellulose pulp to be dried.

7. The process as claimed in claim 1, wherein the particulate cellulose pulp is dried to a solids content of up to about 60%.

8. The process as claimed in claim 1, wherein the particulate cellulose pulp is dried to a solids content of up to about 95%.

9. The process as claimed in claim 1, which comprises imparting kinetic energy to the steam-particulate cellulose pulp mixture in at least in one zone along the confined path.

10. The process as claimed in claim 9, wherein kinetic energy is imparted to the steam-particulate cellulose pulp mixture following each step and prior to each heat-transfer step.

11. Apparatus for drying particulate cellulose pulp comprising a pressure conduit system defining a confined path for a flow of particulate cellulose pulp entrained in steam; means for establishing a flow of particulate cellulose pulp entrained in steam through the conduit system; a multiplicity of heat exchangers in the conduit system for transferring heat into the steam-particulate cellulose pulp mixture in heat exchanger zones; and at least one blower in the conduit system for imparting kinetic energy to the steam-particulate cellulose pulp mixture, the conduit system including a plurality of laterally adjacent, generally parallel conduit sections comprising spaced-apart heat exchangers, heat exchanger including therewithin a plurality of generally parallel tubes carrying the steam-entrained particulate cellulose pulp and a chamber through which the tubes pass and through which heating steam can be conducted over the outsides of the tubes to heat the tubes.

12. Apparatus according to claim 11 comprising means for controlling the supply of particulate cellulose pulp and carrier steam to the conduit to maintain an amount of particulate cellulose pulp not greater than 0.35 kg dry weight for each 1.0 kg of carrier steam

13. Apparatus according to claim 11 comprising means for controlling the supply of heat to the heat exchangers and the superheating temperature of the carrier steam and the moisture content of the particulate cellulose pulp processed in the apparatus.

14. Apparatus as claimed in claim 11 comprising cyclone means for separation of particulate cellulose pulp and carrier steam before discharge of particulate cellulose pulp from the conduit system.

15. Apparatus as claimed in claim 11, comprising means for recycling steam used as carrier steam to the conduit system for reuse as carrier steam.

* * * * *